US007020897B2

(12) United States Patent
Johnson

(10) Patent No.: US 7,020,897 B2
(45) **Date of Patent: *Apr. 4, 2006**

(54) CUT AWAY VEST

(75) Inventor: Matthew A. Johnson, St. Louis, MO (US)

(73) Assignee: Eagle Industries Unlimited, Inc., Fenton, MO (US)

( * ) Notice: Subject to any disclaimer, the term of this patent is extended or adjusted under 35 U.S.C. 154(b) by 92 days.

This patent is subject to a terminal disclaimer.

(21) Appl. No.: 10/708,313

(22) Filed: Feb. 24, 2004

(65) Prior Publication Data

US 2005/0005343 A1 Jan. 13, 2005

Related U.S. Application Data

(63) Continuation-in-part of application No. 10/604,283, filed on Jul. 8, 2003.

(51) Int. Cl.
*A41D 13/00* (2006.01)

(52) U.S. Cl. ..... 2/102

(58) Field of Classification Search ..... 2/456, 2/460–463, 467, 44, 45, 50, 51, 69.5, 2.5, 2/94, 108, 326, 327–334, 102
See application file for complete search history.

(56) References Cited

U.S. PATENT DOCUMENTS

| | | | |
|---|---|---|---|
| 761,113 | A | 5/1904 | Van Wagoner et al. |
| 842,498 | A | 1/1907 | Schmidt |
| 1,776,044 | A | 9/1930 | Roehm |
| 2,148,152 | A | 2/1939 | Dosberg |
| 2,343,142 | A | 2/1944 | Freedman |
| 2,442,895 | A | 6/1948 | Hill |
| 4,545,773 | A | 10/1985 | Evert |
| 5,060,314 | A | 10/1991 | Lewis |
| 5,259,093 | A | 11/1993 | D'Annunzio |
| 5,495,621 | A | 3/1996 | Kibbee |

(Continued)

FOREIGN PATENT DOCUMENTS

| | | |
|---|---|---|
| CA | 642244 | 6/1962 |

OTHER PUBLICATIONS

U.S. Army Natick Soldier Center, USMC Full Spectrum Battle Equipment, website printout (several views of the vest are included). This body armor/vest is believed to be the vest produced by Point Blank Body Armor, Inc. which was referred to in the original Information Disclosure Statement.

(Continued)

*Primary Examiner*—Tejash Patel
(74) *Attorney, Agent, or Firm*—Blackwell Sanders Peper Martin LLP

(57) ABSTRACT

A vest is provided that may be quickly and easily removed (cut away) from a wearer of the vest. The vest may include a waist belt, a cummerbund, and shoulder straps which may be easily released from the portion of the vest by the use of a flexible retainer in cooperation with a connector device to secure the waist belt, cummerbund and shoulder straps to the vest in a releasable manner. A cable portion of the retainer moves in a generally straight line except for accommodating curved portions of the body of the wearer. An accessory pouch may also be provided which uses a strap and loop arrangement on the vest and pouch to attach the accessory pouch to the vest.

17 Claims, 13 Drawing Sheets

U.S. PATENT DOCUMENTS

| | | | |
|---|---|---|---|
| 5,512,348 | A | 4/1996 | Mazelsky |
| 5,516,234 | A | 5/1996 | Duchesne |
| 5,806,740 | A | 9/1998 | Carlson |
| 5,897,468 | A | 4/1999 | Lumpkin |
| 5,966,747 | A | 10/1999 | Crupi et al. |
| 6,029,270 | A | 2/2000 | Ost et al. |
| 6,035,452 | A | 3/2000 | Braxton |
| 6,098,196 | A | 8/2000 | Logan |
| 6,185,738 | B1 | 2/2001 | Sidebottom |
| 6,421,833 | B1 | 7/2002 | Khanamirian et al. |
| 6,769,137 | B1 | 8/2004 | D'Annunzio |

OTHER PUBLICATIONS

Point Blank Body Armor, Inc., Nato QR Full Spectrum Battle Equipment, website printout dated Nov. 5, 2003.

Point Blank Body Armor, Inc., Nato QR Full Spectrum Battle Equipment, Digital Photograph with details of cable release system using multiple cables taken Jul., 2004.

CUT AWAY VEST

CROSS REFERENCE TO RELATED APPLICATIONS

This application is a continuation-in-part application of Ser. No. 10/604,283, filed Jul. 8, 2003, for a CUT AWAY VEST.

BACKGROUND OF INVENTION

A cut away vest that may be simply and quickly removed in emergency situations. The vest is particularly usable in tactical and military operations.

Vests, particularly those used in tactical and military operations are well known. The vests are used to carry personal supplies and equipment, e.g., ammunition clips, flashlights, radios and first aid supplies. The vests can also be used to carry bullet resistant armor to help protect the wearer from being wounded in vital body areas. However, the vests have many drawbacks. One problem encountered with such vests is their weight when loaded with supplies. Soldiers have been known to drown because of the weight of the vests which may in part be due to a soldier's inability to remove the vest in an emergency situation. Proposals have been made to improve such vests. An example of a vest of the cut away style, i.e., removable by the soldier without having to unfasten belts and other typical retainers, can be found in published U.S. Patent Application 2002/0120973 to T. B. D'Annunzio. This type of vest is referred to as a cut away vest in which through the use of a release device the entire vest can be removed by the soldier without having to unfasten a series of buckles, clips, hook and loop fasteners, etc. This particular vest utilizes front and rear torso portions with the rear torso portion including a cummerbund to help retain the rear torso portion to the waist of a user. A waist belt is also provided to help retain the front and rear torso portions to the waist of the user. Shoulder straps are provided with the strap portions on the front torso portion being connected to the strap portions on the rear torso portion. Four cables are attached to a handle with each cable being used to releasably retain one of each of the two shoulder straps, the cummerbund and the belt as a unit and when the cables are pulled, these components are released allowing the vest to drop off of the user.

Such a structure though, presents problems. Multiple points of attachments are used, each utilizing a separate cable for release. Each of the cables goes through a loop. A loop is formed by inserting strap portion through the hole in a buckle or the like with the axis of the loop opening being fixed by the buckle and the strap or strap to which it is attached. When viewing these connections, particularly at the shoulder straps, the cables bend generally to a right angle requiring the cable to be pulled around a corner for release from the loop and buckle arrangement. The use of four cables also requires additional time to assemble the vest. The use of such a cable arrangement makes it unnecessarily difficult to release the vest from the wearer. Also, the rear shoulder portions of the shoulder straps are connected to the front shoulder strap portions complicating use and construction of the vest. When the vest is "cut away," the belt is separated from the vest at two ends, the cummerbund is separated at one end and each of the shoulder straps is separated into the front and rear portions at the top of the shoulders.

As discussed, even though the above described vest provides advantages over non-cut away constructions, improvement is still needed.

SUMMARY OF INVENTION

The present invention involves the provision of a cut away vest usable for carrying supplies and equipment and is constructed for a quick release from attachment to a wearer so that the vest can be discarded quickly and effectively in an emergency. The vest also includes pouches that may be easily and effectively mounted on the vest at various locations through the use of a simple fastening system.

In one embodiment, the vest includes front and rear torso panels connected together around the waist of a wearer by a belt. Shoulder straps are provided that connect the front torso panel to the rear torso panel. The shoulder straps are releasably connected to the rear torso panel via a connector device that may easily be separated from the front of the vest by the activation of a flexible retainer. Activation of the retainer will release the shoulder straps from attachment to the rear torso panel. At least two grips are provided with the connector device. The retainer may also be used to separate the belt from the rear torso panel as well as a cummerbund if used, with the two grips permitting the separation from at least two spaced locations. It is preferred that the shoulder straps, cummerbund and belt be releasably connected at a common point and that the retainer be movable in a generally straight line, except for the accommodation of curvature of the body, to effect simultaneous release of the attachment of the shoulder straps, belt and cummerbund.

A supply pouch is attachable to the vest through the use of a strap or web connected to the pouch which alternately extends through loops on the pouch and vest allowing the pouch to be mounted securely in a selected desired position on the vest either at the sides or on the front and back torso panels.

DETAILED DESCRIPTION

Figure 1:
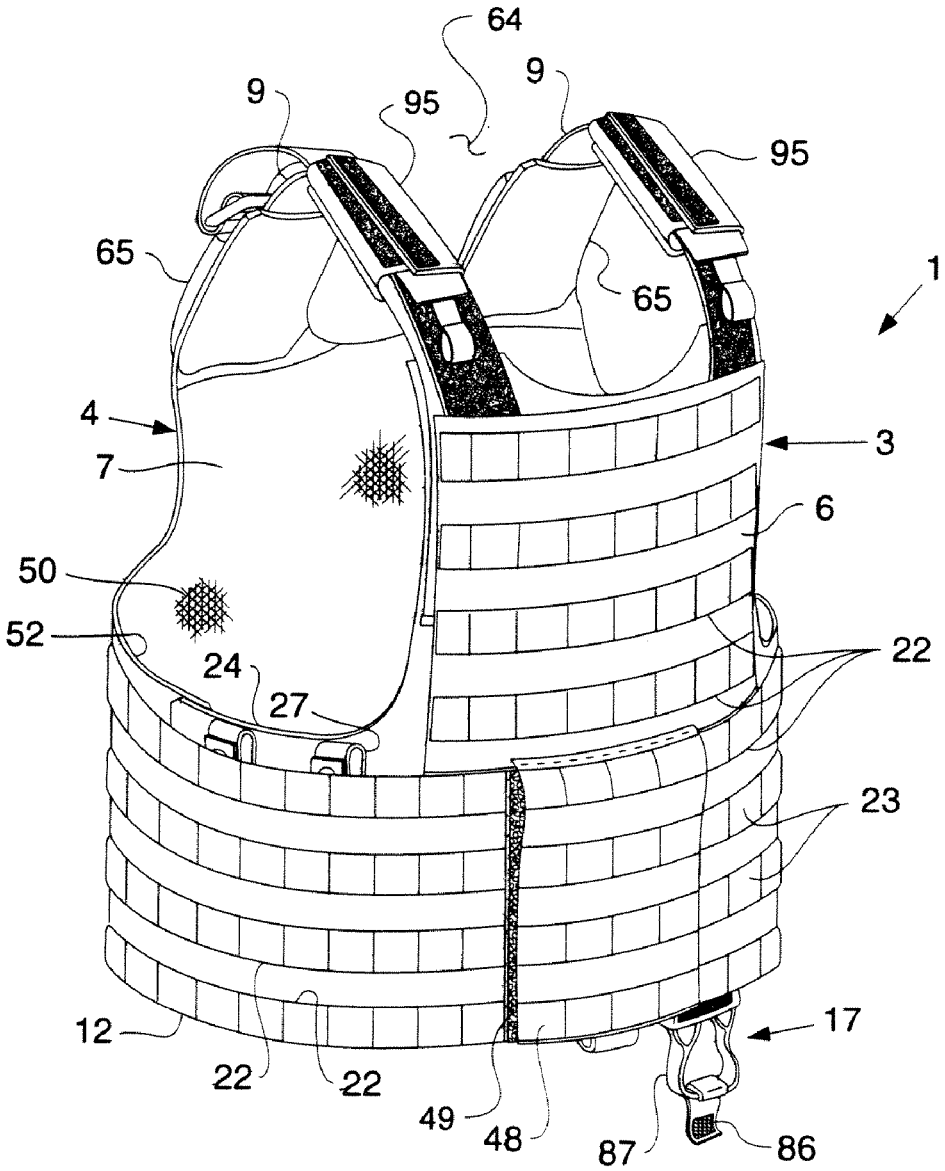
FIG. 1 is a perspective view of the cut away vest of the present invention.

In the illustrated embodiment of the present invention, the cut away vest, designated generally 1, is comprised of a front 3 and a back 4. The front 3 includes a front torso panel 6 and the back 4 includes a back or rear torso panel 7. The front 3 and back 4 are connected together by shoulder straps 9 and a waist belt 12. An internal cummerbund 14 may be provided to help secure the back 4 to a vest wearer or user. Quick release means, designated generally 17, is provided to effect separation of portions of the vest 1 from one another so that the vest may be easily and quickly removed from the wearer particularly in an emergency situation. One or more accessory pouches, FIGS. 3A, B and FIG. 4, designated generally 19, may also be provided for mounting at various locations on the vest 1. Bullet resistant armor 21, FIG. 5, may also be provided in both the front and back torso panels 6, 7.

The front 3 is comprised of a front torso panel 6 formed by multiple overlying layers of sewn fabric. The front 3 may also be provided with a plurality of rows, both vertically and horizontally oriented, of loops 22, FIGS. 1, 3. The loops 22 are formed by horizontally extending webs 23 sewn to the torso panel 6. The front 3 may also be provided with a side portions 24 for wrapping partially around the waist of the wearer. The sides 24 may be provided with accessory pouches integrally formed thereon. Attachment devices 27 may be provided to assist in attaching equipment to the vest 1. The attachment devices 27 are shown as webs working in combination with hook and loop fasteners, strips 28, 29, FIG. 4. The attachment devices 27 may also utilize snap connector 31 to permit removal of a portion thereof. Use of hook and loop fasteners allows for adjustment of the length and the position of the attachment of accessories. Pouches 33 may also be provided. The front 3 may be provided with an internal pouch (not shown) for holding the armor 21. The shoulder straps 9 include front strap portions 37 which may be attached to the front 3. The front strap portions 37 may be provided with a hook and loop fasteners portions 39 for a purpose later described.

The front 3 is preferably provided with an attachment device 40 positioned on the inside of the front 3 adjacent the middle and on the inside of the front 3 for help in securing and carrying a portion of the quick release means 17 for ready access by the wearer. A guide channel 42, which is in the form of a sewn elongate tube, is part of the front 3 and is used to receive therein a portion of the quick release means 17 to retain it to the front 3 and form a pathway for movement of a portion of the quick release means 17 therethrough as later described. The front 3 may also be provided with an attachment device 45 (FIG. 4) for releasably securing a portion of the waist belt 12 thereto as later described. A cover 48 may be provided on the front 3 to cover portions of the waist belt 12 thereunder and to help retain the connection of the ends 80 L, R of the waist belt to one another and to the vest front 3. The attachment device 45 may include hook and loop material portions 49 and the cover 48 may also be provided with hook and loop fastener portion 49 whereby the cover 48 may be secured to the attachment device 45 and yet be releasably attached thereto. The front 3 of vest 1 may also be lined with mesh lining to both form a pouch and for comfort of the wearer.

Figure 8:
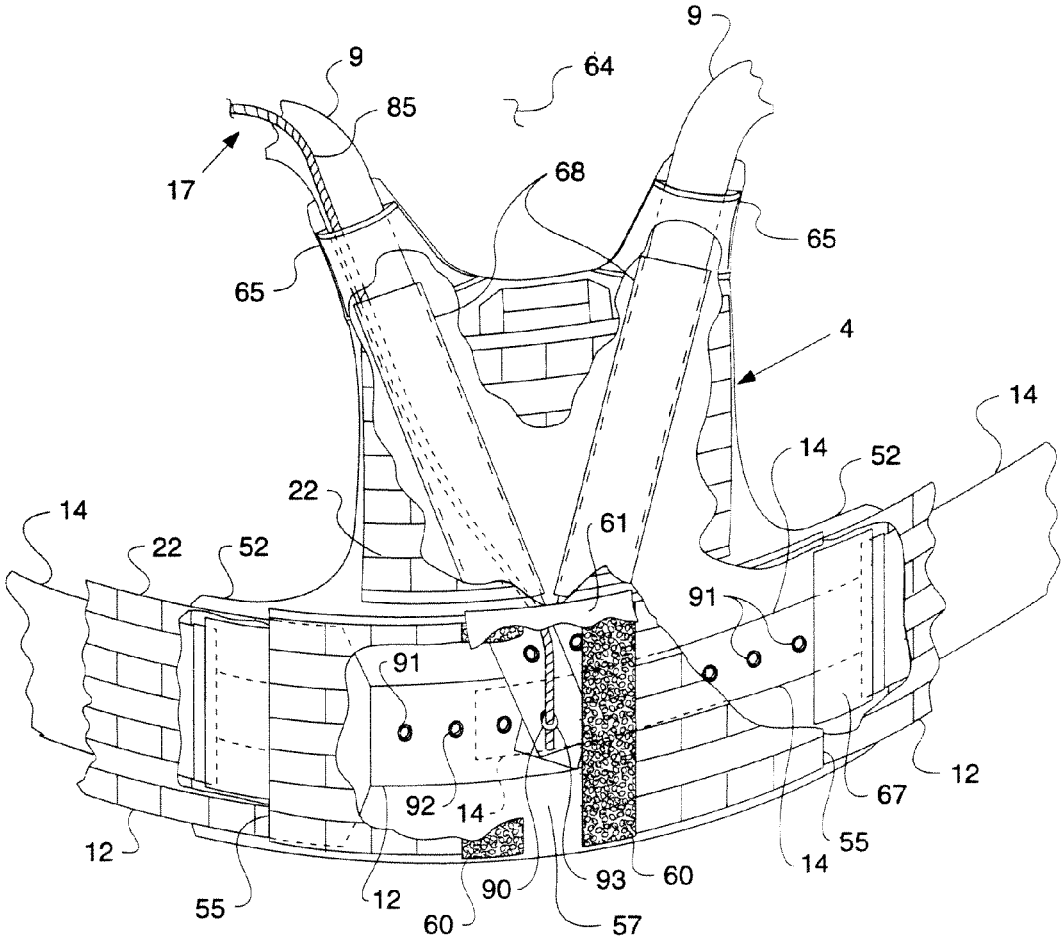
FIG. 8 is a perspective view of the rear torso panel with portions broken away to show details of the connection of the belt, cummerbund and shoulder straps to the rear torso panel and of the connector device.
Figure 9:
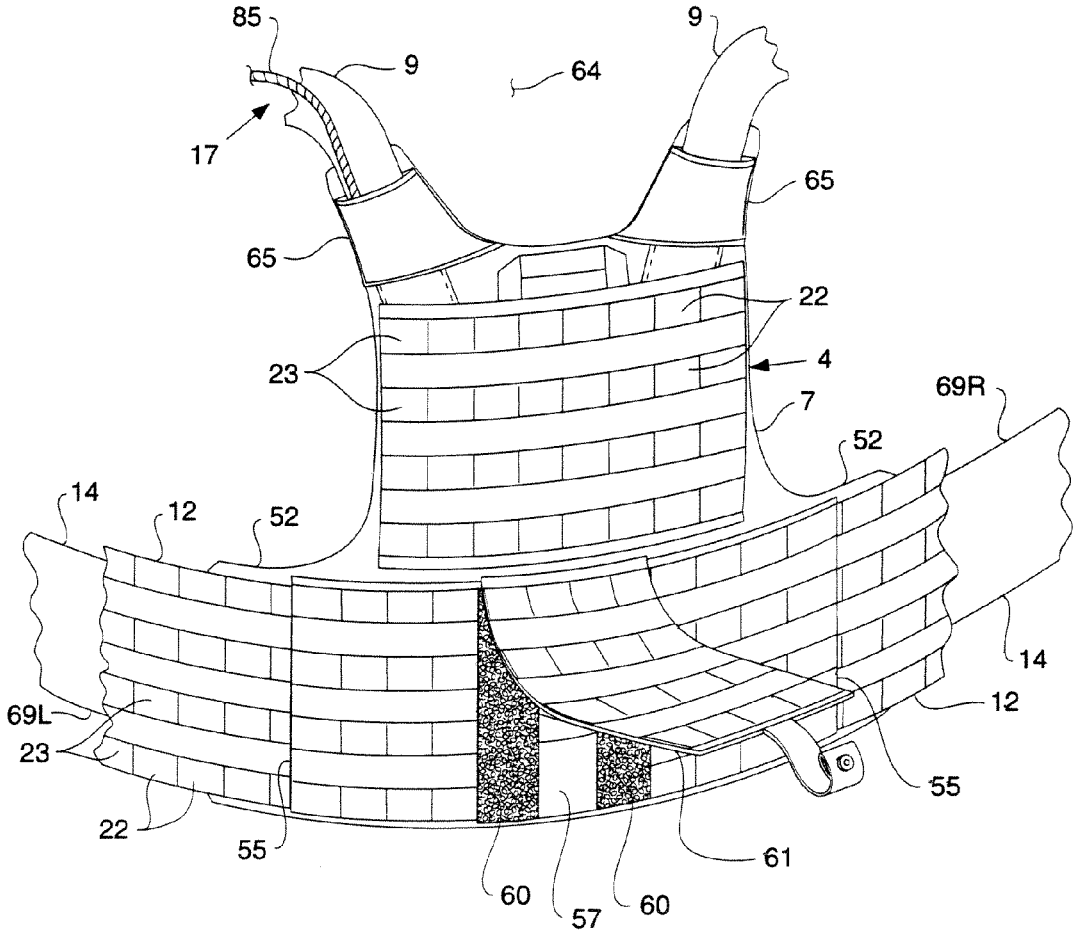
FIG. 9 is an elevation view of the rear torso panel used from the outside.
Figure 10:
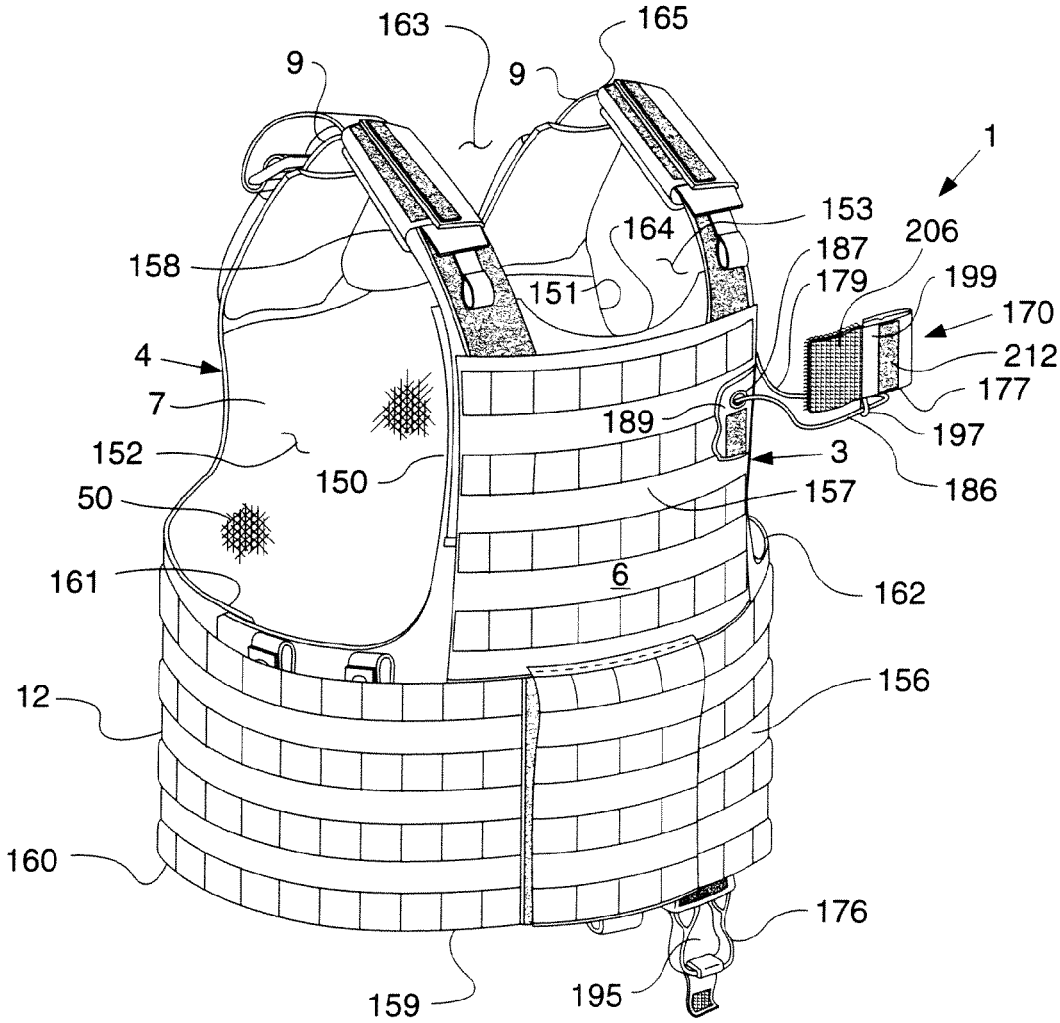
FIG. 10 is a perspective view of a vest with a portion broken away illustrating a modified form of connector device for the vest.
Figure 11:
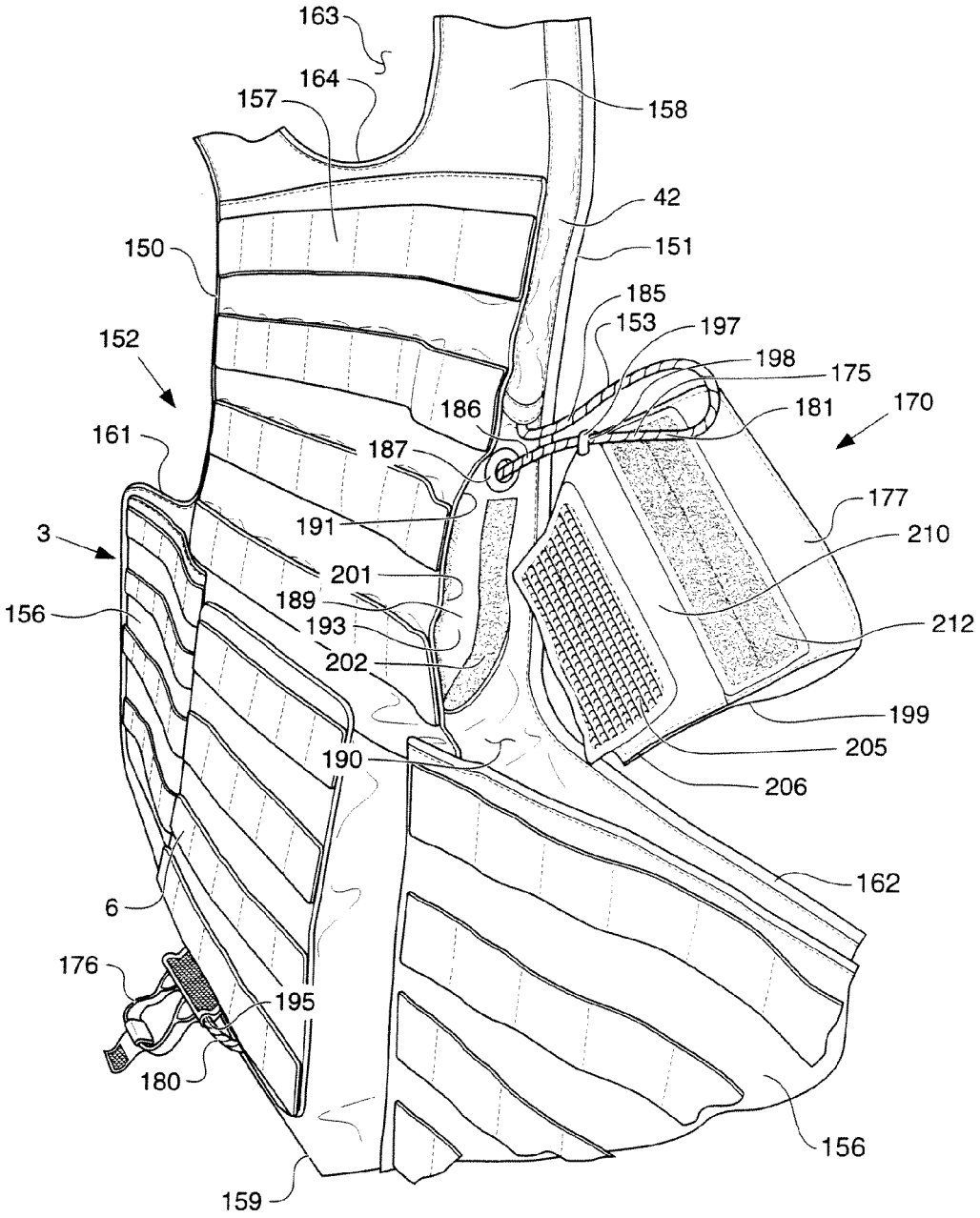
FIG. 11 is an enlarged fragmentary side perspective view of the vest of FIG. 10 showing details of a grip receiving pocket and an activating grip of the connector device.
Figure 12:
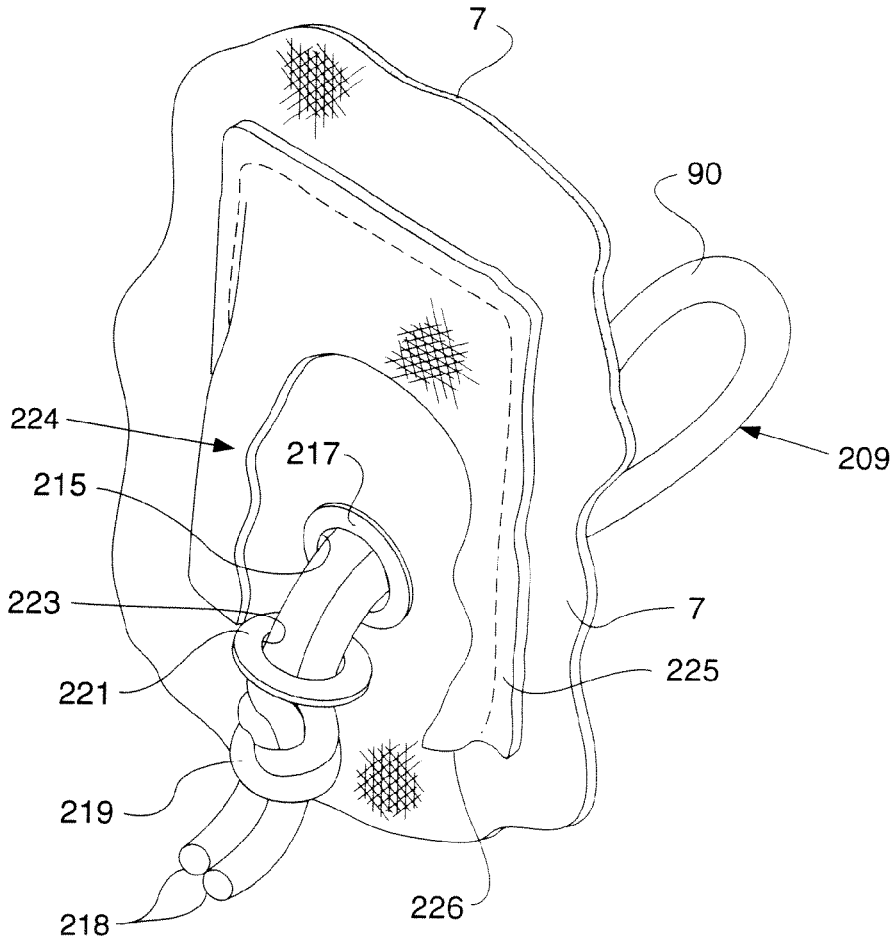
FIG. 12 is an enlarged fragmentary perspective view of a modified form of connector device retainer as seen from the inside of the vest.

The back 4 (FIGS. 4, 5, 8) includes the back torso panel 7. At the lower portion of the back 4 there are side portions 52 which will wrap partially around the waist of the wearer. On the lower portion of the back 4 there is also provided a pair of generally horizontal and aligned sleeves 55 for receipt therethrough of portions of the cummerbund 14 and waist belt 12. There is an opening or gap 57 between the inside edges of the sleeves 55 for a purpose later described. On opposite sides of the opening 57 there are provided attachment devices such as hook and loop closure elements 60 which will releasably retain a cover flap 61 in overlying relation to the opening 57 allowing the opening 57 to be selectively exposed and covered. The back 4 further contains a pouch 63, FIG. 5, for holding armor 21 when desired. As with the front 3, the inside surface of the back 4 may be a mesh lining 50. Additional pouches (not shown) may be formed between the mesh lining 50 of the back 4 and the remainder of the back for storing accessories or supplies.

Figure 4:
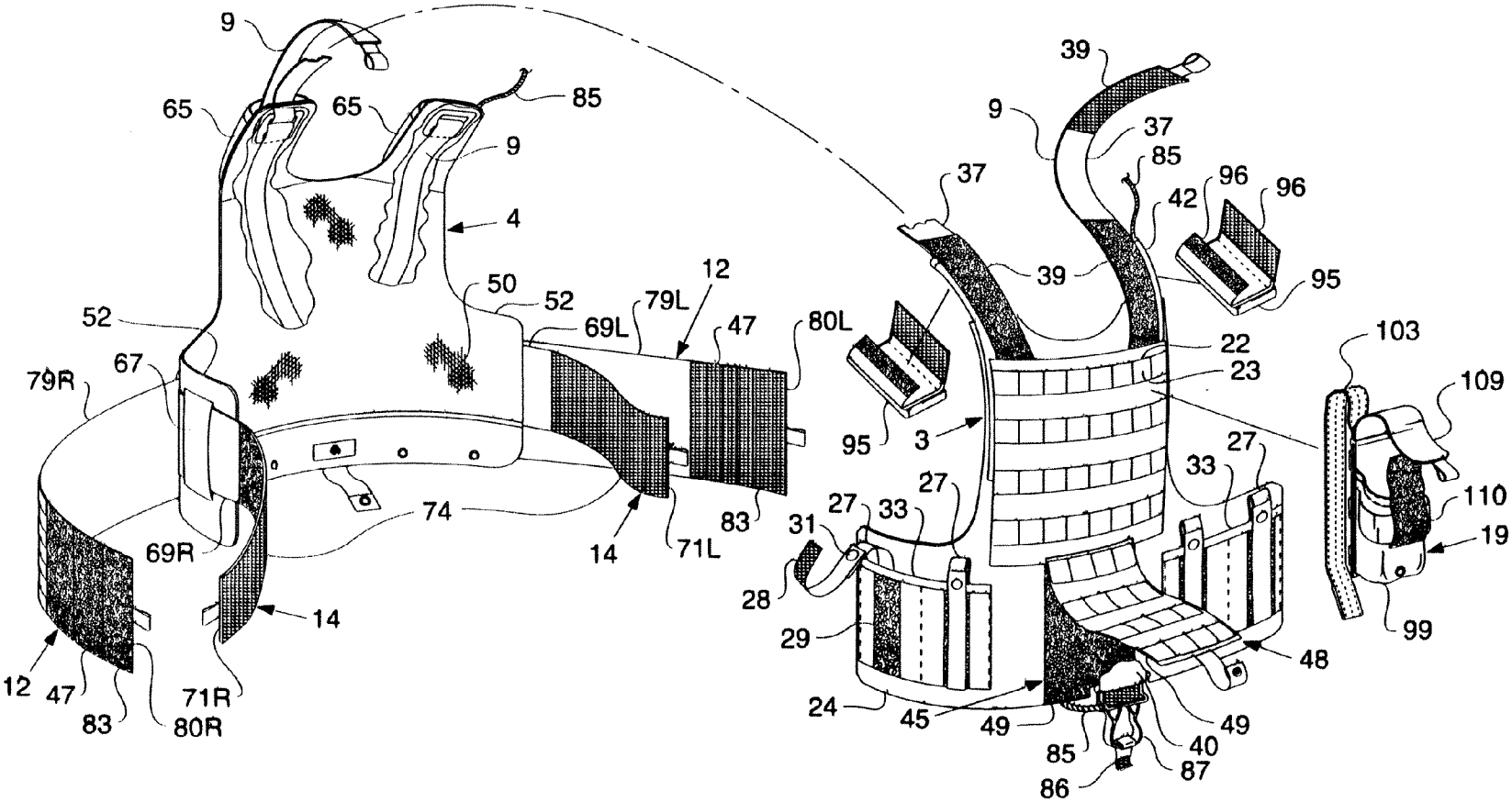
FIG. 4 is an exploded perspective view of the vest.
Figure 5:
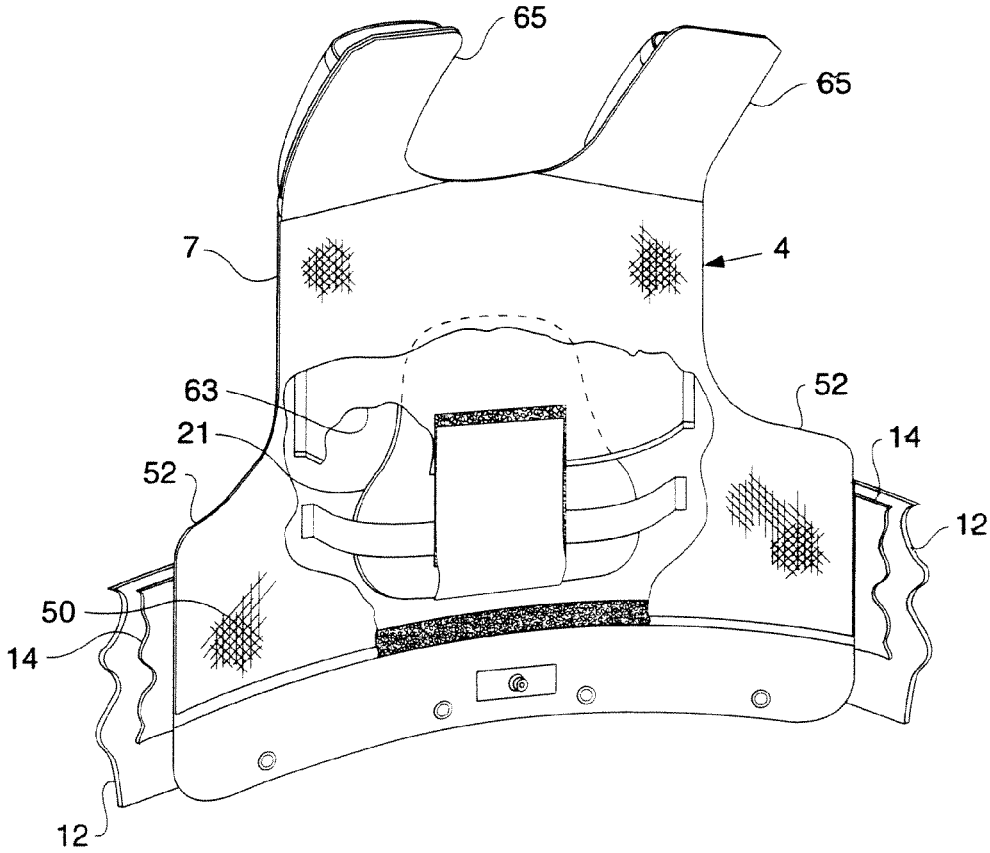
FIG. 5 is a perspective view of the rear torso panel seen from the inside of the rear torso panel.

Ears 65 in the form of flat tubes are provided adjacent the upper edges of the main portion of the back torso panel 7 and are separated laterally to form an opening 64 for the neck of a wearer. The ears 65 may be padded for comfort and they may directly overlie a portion of the wearer. The exterior of the back 4 may be provided with vertically and horizontally spaced loops 22 as does the front 3. The loops 22 on the back 4 may be utilized for the releasable attachment of accessory pouches or equipment and accessories to the vest 1. Sleeves 67, FIG. 4, are formed on the sides 52 for receipt of portions of the cummerbund 14 therethrough and to help separate the cummerbund from the belt 12 and also provides support for the back 4 during use by the wearer. The sleeves 67 are aligned with one another, and have an axis generally parallel to and preferably in line with the axis of the belt sleeves 55 and extend generally horizontally. The remainder of the cummerbund 14 inside the back 4 passes through a respective belt sleeve 55 and may extend partly or completely through the belt sleeve 55 on the opposite side of the back 4. Sleeves 68 (FIG. 8) extend from adjacent to the bottom edges of the ears 65 to an area adjacent the opening 57 for receipt therethrough of portions of the shoulder straps 9. Sleeves 68 incline downwardly and inwardly from the ears 65 toward the center and bottom of the back 4 adjacent the opening 57.

Figure 2:
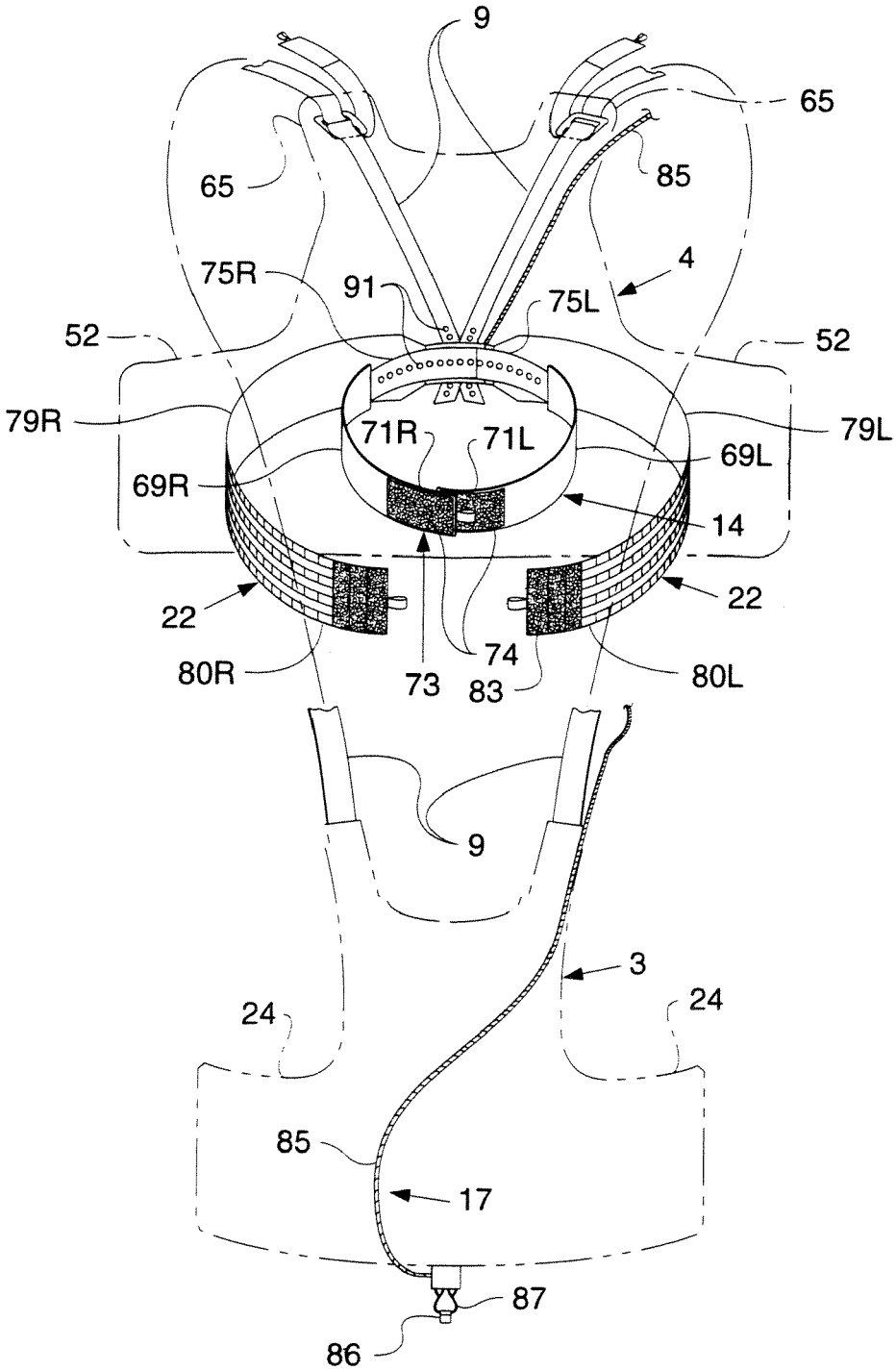
FIG. 2 is a schematic perspective view showing the shoulder straps, cummerbund and waist belt and their relationship to one another and to the rear torso panel.
Figure 6:
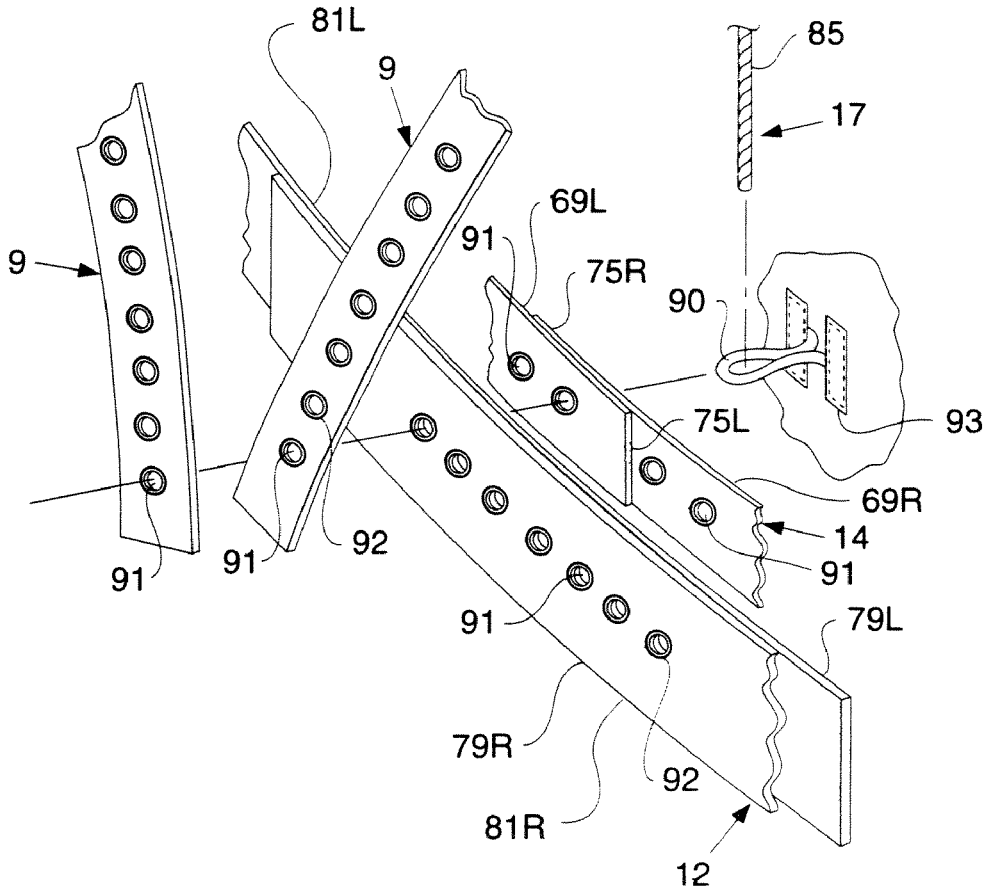
FIG. 6 is a fragmentary exploded view of the belt, cummerbund and shoulder straps showing the details of the connection of the belt, cummerbund and shoulder straps to the connector device connecting the same to the rear torso panel.
Figure 7:
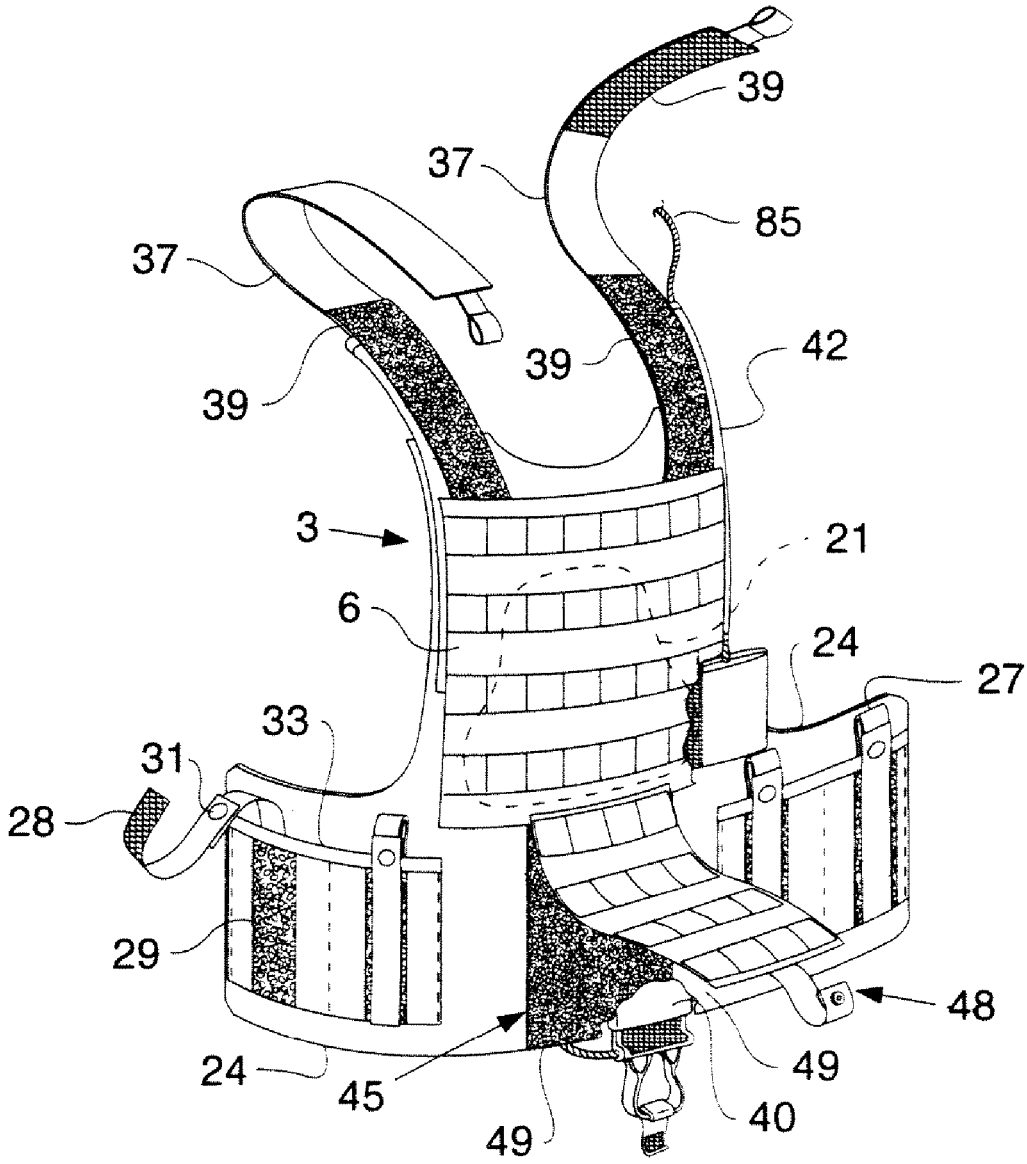
FIG. 7 is a perspective view of the front torso panel showing various details thereof and of an armor plate carried thereby shown in phantom.

The illustrated cummerbund 14, FIGS. 2, 4, and 6, is in the form of a belt with left and right side portions 69 L, R respectively and has a width of, for example, approximately 4 inches. The cummerbund 14 is constructed to have adjustable length to accommodate different size wearers. As shown, each of the cummerbund side portions 69 L, R has an end 71 L, R, respectively (preferably free ends), which would be positioned at the front of the wearer and has an attachment device 73 at the free ends. Any suitable attachment device 73 can be used, for example, buckles, clasps, etc. In the illustrated structure, a hook and loop fastener arrangement 74 is utilized with the hook portion of fastener 74 on one free end 71 and the loop portion of fastener 74 secured to the other of the free ends 71. In the illustrated structure, each of the cummerbund portions 69 L, R also has an end 75 L, R for attachment at the back of the back 4. However, it is to be understood that one of the ends 75 may be permanently attached to the vest 1 so long as one portion of the cummerbund may be released from the vest and the wearer in a manner later described. Preferably both ends 75 are free ends. The ends 75 of the cummerbund 14 may overlap inside the back 4 and portions of the cummerbund 14 are accessible through the opening 57. The cummerbund 14 is releasably attached to the vest 1 in a manner later described whether or not the attachment device 73 is closed or open.

The belt 12 has two side portions 79 L, R at least one of which is releasable from the vest 1 in a manner later described (FIGS. 2, 6). Each side portion 79 L, R has opposite ends 80 L, R, 81 L, R respectively which are preferably free ends, with the end 80 being positioned adjacent the front of the wearer and vest 1 and the end 81 being positioned at the back of the wearer and vest 1. In illustrated embodiment, both portions 79 of the belt 12 are completely releasable from the vest 1. The ends 81 of the belt portions 79 are received through the sleeves 55 and are exposed for access through the opening 57. The belt 12 at the ends 80 may be provided with an attachment device for securement of the portions 79 to one another and preferably to the vest front 3. As seen, hook and loop fastener elements 82, 83 are provided allowing the ends 80 to be releasably attached to one another and to the attachment device 45 on the front 3. The cover 48 may also be secured through a hook and loop fastener arrangement 49 to the exposed surface of the belt 12. The belt 12 may also be provided with the vertically and horizontally extending rows of loops 22. The ends 81 are received through the sleeves 55 and portions of the belt 12 are exposed for access through the opening 57. Preferably, the belt side portions 79 are portioned outside of the cummerbund side portions 69.

The quick release means 17 is operable for selectively retaining and releasing at least one belt portion 79, at least one cummerbund portion 69 and at least one shoulder strap 9 from the vest 1 in a manner that the vest may be quickly and easily cut away from the wearer in a reliable and quick manner. In the illustrated structure, the quick release means 17 includes a flexible retainer such as a plastic coated metal cable 85 having a handle 87 on one end and attachable and accessible to the front 3 and releasably retained in position by a fastener 86. The cable 85 is carried by both the front and rear torso panels 6 and 7 and passes through the channel 42, ears 65 and sleeve 68 and extends down to the area of the opening 57 for access by a user and releasably secures at least one of the belt 12, side 79, cummerbund 14 side portion 69, and at least one shoulder strap 9 to the vest 1 in a releasable manner. The attachment is shown being effected on the back torso panel 7. It is to be understood that the attachment in an alternative embodiment can be on the front torso panel 6. It is however preferred that the attachment be made on the back 4. The quick release means 17 further includes a multi-orientation and self-aligning (the cable 85 can orient and maintain orientation of the loop 90) attachment device such as a flexible fabric loop 90 attached to the back torso panel 7, as by sewing, and has a length sufficient to pass through at least one shoulder strap 9, one cummerbund portion 69, and at least one belt portion 79. As shown in FIG. 6, both shoulder straps 9, cummerbund portions 69 L, R and belt portions 79 L, R each have a plurality of spaced apart openings 91 extending longitudinally in a respective row along a portion of the length thereof. Preferably, the openings 91 are formed by metal eyelets 92 secured thereto through which the loop 90 may be passed. In order, from inside to outside the belt portions 79 which overlie the cummerbund portions 69 and the straps 9 having their end portions overlying the belt portions 79. The loop 90 is passed through generally aligned eyelet openings 91 and the cable is then passed through the open end 93 of the loop 90 releasably securing the belt 12, cummerbund 14 and straps 9 to the back torso panel 7. The cable 85 will align the loop 90 for generally straight line movement of the cable during release movement by pulling the cable 85 out of the loop 90. With the cable 85 out of the loop 90, the belt 12, cummerbund 14 and straps 9 are released from attachment to the back 4 allowing the front 3 and back 4 to separate with the straps 9 being pulled through the sleeves 68 whereby the front 3 and back 4, will under their own weight, fall from the wearer. The weight of the vest 1 and the accessories attached thereto are sufficient to effect release of the vest from the wearer when the cable 85 is no longer retained in the loop 90.

In the illustrated embodiment, the portion of the cable 85 from the loop 90 to the wearer's shoulder moves in a generally straight line, then can move around the curvature of body portions, e.g. the shoulder of the wearer to effect release of the vest 1 from the wearer. Although multiple attachment points could be used, for example the shoulder straps could have their own attachment loop 90 while the belt and cummerbund could share a common loop or other arrangements of these points could be used. It is preferred that the attachment is made through a single attachment point. If multiple attachment points are used, they are to be generally aligned in order that the cable 85 may still move in a straight line (except for accommodating body curvature) through the attachment points.

While the attachment point is shown on the back 4, it is to be understood that the attachment point can be on the front 3. The handle 87 is shown as positioned at the lower portion of the front 3, however, it is to be understood that it could be positioned at different locations. One military service currently prefers that it be at the lower part of the front of the vest 1 while another service currently prefers that it be adjacent an upper portion of the front 3, i.e., adjacent the shoulder of the wearer. In this event, multiple cables 85 can be provided with a vest to provide the option to the wearer as to where to have the handle 87 located. The handle 87 is secured in its position by fastener 86 to help prevent accidental release. The shoulder straps 9 are connected to the front 3 and to the rear torso panel 7 and preferably are free to move through the ears 65 by not being attached thereto. Pads 95 may be provided at the shoulder straps 9 to improve the comfort of the wearer when using the vest 1. The pads 95 may be releasably mounted to the straps 9 through the use of hook and loop type fastening elements 96 whereby the pads wrap around a respective shoulder strap 9.

Figure 3A:
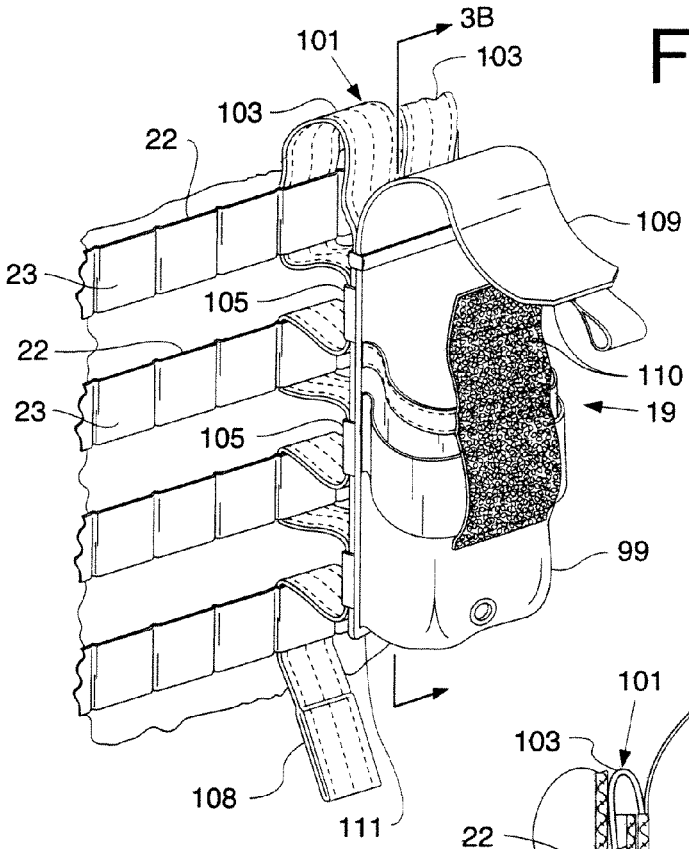
FIG. 3A is a perspective view of storage pouch mounted to the vest with the attachment straps being shown in an untightened condition.
Figure 3B:
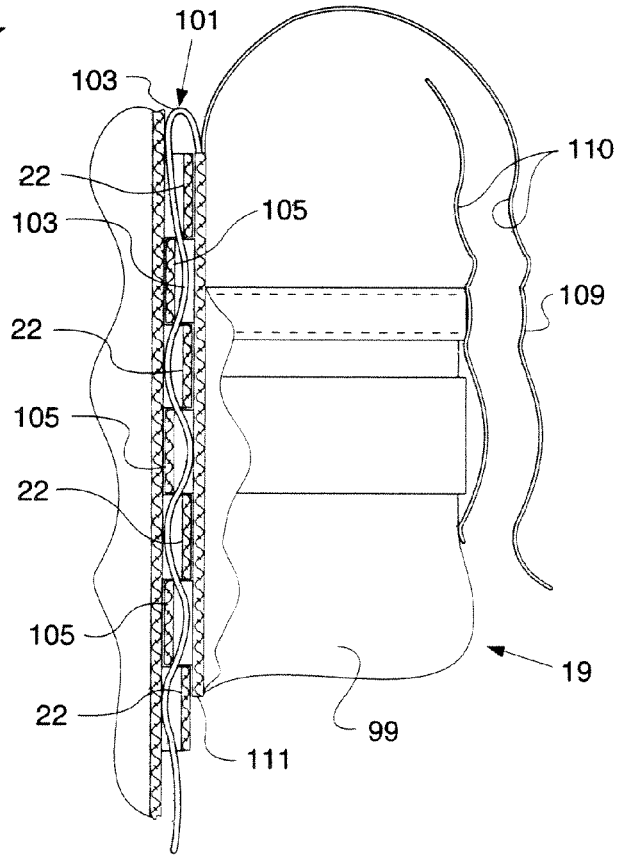
FIG. 3B is a sectional view of the storage pouch of FIG. 3A taken along the line 3B—3B of FIG. 3A showing the attachment strap in tightened condition.

An accessory pouch 19, as best seen in FIGS. 3A, B, and 4 may be removably attached to the vest 1 at any of the locations where the loops 22 exist. Accessory pouch 19 includes a pouch portion 99 with an attachment device designated generally 101 which is interengagable with portions of the vest 1 for releasable attachment of the accessory pouch 19 to the vest 1. As seen, the accessory pouch 19 includes at least one and preferably two straps 103 preferably attached to and extending from the top of the pouch portion 99. Loops 105 extend across the width, i.e., generally horizontally when in use, of the accessory pouch 19 on the back 106 thereof. A strap 103 alternately inserted in the loops 22 then loop 105 and then another loop 22 and then a loop 105 forming a weave that removably attaches the accessory pouch 19 to the vest 1. The free end of the straps 108 may be left hanging or may be inserted into a lower disposed loop 22 if desired. Accessory pouch 19 may be provided with a closeable top 109 that can be releasably attached to the pouch portion 99 via a hook and loop fastener arrangement 110 for sealing the interior of the pouch to prevent loss of material or supplies contained therein. While the straps 103 are shown as being attached and extending from the top of the pouch portion 99 they may, in an alternate embodiment, extend from the bottom 111 of the accessory pouch 19 and woven upwardly instead of downwardly through the loops 22, 105. Also, one strap 103 may extend from the top and one may extend from the bottom. Thus, the entire length or height of the accessory pouch 19 can be firmly held against the vest 1.

FIGS. 10–13 illustrate additional embodiments of the release system for cutting away the vest from a wearer. The vest 1 includes a front 3 and a back 4. The front 3 includes a front torso panel 6 and the back 4 includes a rear torso panel 7. The front 3 and back 4 connected together by shoulder straps 9 and waist belt 12. The vest 1 is described in detail above, which description is generally applicable to the embodiment shown in FIGS. 10–13. The vest 1 has edge portions 150, 151 defining armholes 152, 153, respectively. The vest 1 further includes an abdominal portion 156, chest portion 157, and a shoulder portion 158. The abdominal portion 156 is positioned generally between the bottoms 161, 162 of the armholes 152, 153 respectively, and the bottoms 159, 160 of the front 3 and back 4 respectfully. The chest portion 157 is generally between the bottoms 161, 162 of the armholes 152, 153 and the bottom 164 of the neck hole 163. The shoulder portion 158 is generally between the bottom 164 and the top 165 of the shoulder straps 9 when the vest is in condition assembled for use.

The release system designated generally 170 is provided to effect separation of various components of the vest 1 from one another so that the vest 1 may be easily and quickly removed from the wearer particularly in an emergency situation. The release system 170 is similar to the release system 17 described above. As shown, the release system 170 includes a flexible retainer 175 such as a polymeric coated flexible metal cable having at least two grip members 176, 177. The grips 176, 177 are fixed or connected to the retainer 175. The retainer 175 has opposite end portions 180, 181. The end portion 180 is positioned adjacent to the abdominal portion 156 of the front 3 and the end portion 181 is positioned adjacent to the back 4 as described above for the release system 17. The retainer 175 has an intermediate portion 185 with a portion 186 thereof exposed adjacent the chest portion 157. The retainer 175 is mostly contained within the inside of the vest 1 by being positioned between layers of fabric or in guide channels like guide channel 42 like the release system 17 described above. However, the retainer 175 has the intermediate portion 185 exposed by passing through a grommet 187 which opens adjacent the armhole 153. The retainer 175 may have the portion 186 exposed adjacent either the left or right armhole 153, 152. The retainer 175 then is contained within the guide channel 42 leaving a small portion 186 of its length exposed for a purpose later described. The front, includes a pocket 189 defined by surfaces 190, 191 and has an opening 193 opening generally toward the armhole 153.

The release system 170 includes the two grips 176, 177. The grip 176 is fixed to an end portion 180 of the retainer 175 and is preferably permanently affixed thereto. By permanently affixed, it is not meant that the grip 176 cannot be moved but is meant to be a relatively permanent part of the release system 170. As shown, the grip 176 is in the general shape of a D or an O having a through hole 195 with the retainer 175 being attached to one edge or extending around the hole 195. The grip 176 is preferably sewn fabric containing a portion of the retainer 175 between the layers of material forming the grip 176. The grip 176 is sized and shaped to help ensure positive non-slip gripping by a wearer of the vest 1. The grip 176 is positioned adjacent the abdominal section 156 and is shown as positioned where it depends from the lower edge 159 and is generally centrally located at the bottom of the front 3. It is to be noted that the grip 176 may be located at other locations on the vest 1 if desired. The grip 176 is in spaced relationship to the grip 177 to provide two separate and spaced positions in which the release system 170 may be activated to cut away the vest 1. The grip 177 is fixed to the retainer 175. Preferably, and in the illustrated structure, the release system 170 includes a single retainer 175 with both grips 176, 177 being fixed thereto for operation of the release system 170. Preferably, the grip 177 is movably mounted on the retainer 175. That is, the grip 177 may move along the length of the intermediate portion 186 of retainer 175 particularly during operation of a release system 170 to cut away the vest. As shown, the grip 177 is mounted to the retainer 175 through the use of a flexible fabric loop 197 secured to and extending from the grip 177 having a through hole 198 through which the retainer 175 extends. The loop 197 may be made of a braided chord or rope sewn to the body 199 of the grip 177. The body 199 is sized and shaped preferably to be at least partially received within the pocket 189.

An attachment system is provided to releasably secure at least a portion of the grip 177 within the pocket 189. See FIG. 11. It has been found particularly effective to use hook and loop fastener material members to provide for the releasable securement. Hook and loop fasteners are well known in the art with some being sold under the brand Velco®. As seen, either hook or loop material members 201, 202 are secured to the opposite surfaces 191, 190 respectively, having either a hook portion or a loop portion exposed to the interior of the pocket 189. The body 199 has secured thereto, hook or loop fastener material members 205, 206 which have the hooks or loops exposed and engageable with the hook or loop members 201, 202 to secure at least a portion of the grip 177 within the pocket 189 and to provide for selective release thereof from the front 3 and removal from the pocket 189. As shown, the members 201 and 202 are loop members while the members 205 and 206 are hook members. Additionally, the grip 177 has an intermediate or central portion 210. The member 205 is on one side of the intermediate portion 210 and on the opposite side of the intermediate portion 210 there can be provided a hook or loop material member 212. In the illustrated structure, the member 212 is a loop member which can be secured to the member 205 leaving a portion of the member 205 for securement to the member 202. A member 212 may be provided on both of opposite sides of the grip 177. This allows the grip member to have an enlarged surface size which can be reduced by folding the grip over at the central portion 210 if desired. The grip 177 can be releasably secured within the pocket 189 by engagement between the members 201, 202, 205 and 206. To release the grip 177 a wearer need only grip the exposed portion thereof and pull out to release engagement between the member 206 and 201 or the securement may be released by pulling the grip 177 sideways to move the members 205, 206 generally parallel to the members 201, 202. Use of the grip 177 may be facilitated by having the portion to which the member(s) 212 is attached with an increased thickness as by having a foam piece sewn into the interior. Further movement of the grip 177 out of the pocket will induce tension in the retainer 175 and upon the appropriate amount of movement the retainer 175, the retainer 175 will be released from, or displaced from, the loop 90, FIG. 6, or loop 209, FIG. 12, releasing the straps 9 from the side portion 79L, R, and cummerbund portions 69L, R, from retention to allow the vest to be cut away, FIG. 4.

Figure 13:
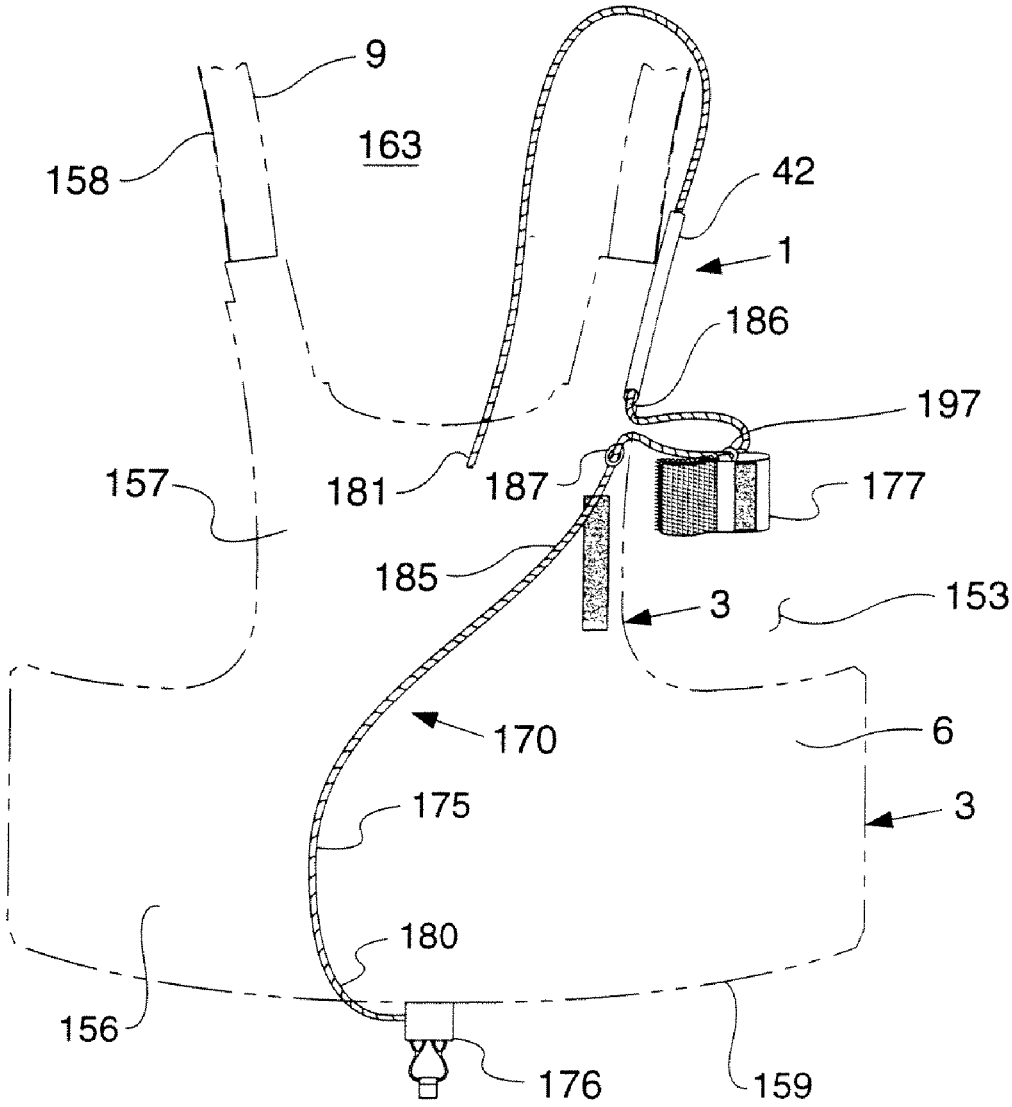
FIG. 13 is a schematic front view of the vest showing details of a portion of the connector device.

FIG. 13 illustrates a modified embodiment of the attachment or securement device retainer loop 209. As described above, the loop 90 is attached to the rear torso panel 7 via overlying sewn fabric members. In the embodiment shown in FIG. 13, the retainer loop 209 is easily replaceable. As shown, the retainer loop 209 extends through a hole 215 defined by a metal grommet 217 secured to one or more of the layers of fabric of the rear torso panel 7. The retainer loop 209 may be formed from a braided or twisted chord or rope having the free ends 218 thereof joined together at a knot 219 to form an enlarged end portion. Because the loop 209 is formed of a fabric type material that is compressible, it is desired to prevent the knot 219 from being pulled through the hole 215. In order to help prevent pull through, a stop 221 such as a disk or metal washer may have the small end portion of retainer loop 209 passed through a through opening 223 to a position wherein the knot 219 engages one surface of the stop 221. The stop 221 is sized and shaped to prevent its passing through the hole 215. As seen in FIG. 13, the stop 221 and knot 219 may be enclosed within a pouch 224 formed by a layer of fabric 225 sewn on the sides thereof leaving one portion open at 226 to provide access for replacement of the retainer loop 209 should it become damaged or worn. Also, on the exposed end of the retainer loop 209, re-enforcing layers of material may be sewn to the rear torso panel 7 around the grommet 217.

Thus, there has been shown and described several embodiments of a novel cut away vest, which fulfills all of the objects and advantages sought therefor. Many changes, modifications, variations and other uses and applications of the present constructions will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A cut away vest comprising:

a first torso panel;

a second torso panel;

shoulder straps connected to the first panel extending to the second torso panel, at least one said shoulder strap having a free end and at least one first connector element;

a waist belt having at least one side portion with a free end connecting a lower portion of one of the first torso panel and second torso panel to the other of the first torso panel and second torso panel, said belt side portion having at least one second connector element;

at least one connector device connected to the second torso panel and selectively operably associated with a respective at least one of the first and second connector elements; and a retainer system having a flexible retainer element carried by at least one of the first and second torso panels to releasably retain the first and second connector elements associated each with a respective connector device, said retainer system including at least first and second grip members each operably associated with a said flexible retainer element, said grip members being normally positioned on an assembled vest in spaced relationship and adjacent the first torso panel, said grip members being operable, independent of one another, when sufficiently moved to release the first and second connector elements each from its respective connector device.

2. A cut away vest as set forth in claim 1 including a cummerbund associated with at least one of the first and second torso panels and having at least one side portion with a first free end overlying a portion of the second torso panel adjacent at least one said connector device, said cummerbund having at least one third connector element associated with a respective said cummerbund side portion with a free end and selectively operably associated with at least one said connector device and releasably retained to the second torso panel by the flexible retainer element.

3. A cut away vest as set forth in claim 2 wherein the first, second and third connector elements each including at least one hole through a portion of said at least one shoulder strap, at least one waist belt side portion and at least one said cummerbund side portion respectively.

4. A cut away vest as set forth in claim 3 wherein each said shoulder strap having a free end and at least one first connector element, said waist belt having at least two side portions with free ends with each waist belt side portion having at least one second connector element and said cummerbund having at least two side portions with free ends with each cummerbund side portion having at least one third connector element, said at least one connector device being one connector device operably associated with at least one of said first connector elements in each of the shoulder straps, at least one said second connector element in each of said waist belt side portions and at least one said third connector element in each of the cummerbund side portions.

5. A cut away vest as set forth in claim 4 wherein the first, second and third connector elements each including at least one hole and said connector device including a flexible loop attached to the second torso panel selectively extendable through holes of the first, second and third connector elements.

6. A cut away vest as set forth in claim 5 wherein each of the shoulder straps, waist belt side portions and cummerbund side portions having a plurality of first, second and third connector elements respectively in spaced apart relation to provide adjustability of length of the shoulder straps, waist belt, and cummerbund.

7. A cut away vest as set forth in claim 1 wherein the flexible retainer element including a single flexible cable extending from the connector device to the first torso panel, said flexible retainer element also including a handle portion adjacent an end of the cable and carried by the first torso panel.

8. A cut away vest as set forth in claim 7 wherein there is a single flexible loop extendible through holes comprising the first, second and third connector elements in the shoulder straps, waist belt and cummerbund respectively.

9. A cut away vest as set forth in claim 7, wherein said cable having opposite end portions, the first grip being fixed to the cable at one end portion, said second grip being normally positioned on the cable at an intermediate position between the opposite end portions.

10. A cut away vest as set forth in claim 9, wherein said second grip being mounted on said cable and movable along the length of said cable.

11. A cut away vest as set forth in claim 10, wherein the first grip being permanently secured to the cable.

12. A cut away vest as set forth in claim 11, wherein said vest including a chest portion and said second grip being normally positioned adjacent said chest portion.

13. A cut away vest as set forth in claim 9, wherein said vest including a chest portion and the cable having an exposed portion adjacent to said chest portion with said second grip being positioned on the cable at the exposed portion of the cable.

14. A cut away vest as set forth in claim 9, including a pair of opposed surfaces defining a pocket positioned adjacent an armhole defining edge of a said torso panel, said pocket being adapted to receive at least a portion of said second grip therein.

15. A cut away vest as set forth in claim 14 including a fastener device releaseably retaining at least a portion of the second grip within said pocket.

16. A cut away vest as set forth in claim 15, wherein the fastener device including one of a hook or loop fastener material member positioned within said pocket for releasable fastening engagement with a hook or. loop fastener material member fixed to said second grip.

17. A cut away vest as set forth in claim 9, wherein said second grip including a loop member having a through opening, said cable being fixed to said second grip by passing through the through opening of the loop member.

* * * * *

UNITED STATES PATENT AND TRADEMARK OFFICE

CERTIFICATE OF CORRECTION

PATENT NO. : 7,020,897 B2
APPLICATION NO. : 10/708313
DATED : April 4, 2006
INVENTOR(S) : Matthew A. Johnson It is certified that error appears in the above-identified patent and that said Letters Patent is hereby corrected as shown below:

Title Page
Item (56) References Cited, under Other Publications insert

- - Figures A1, A2, and A3, for Cut Away Vest (Digital Photographs). - -
- - Figures B1, B2, B3, B4, B5, B6 and B7, for Cut Away Vest (Digital Photographs) - -

Col. 7, line 67, delete "moved" and insert - - removed - -

Signed and Sealed this

Fifth Day of September, 2006

JON W. DUDAS
*Director of the United States Patent and Trademark Office*